United States Patent [19]

Nott

[11] 4,098,688

[45] * Jul. 4, 1978

[54] BRIGHTENING OF CLAY BY FROTH FLOTATION

[75] Inventor: Alan J. Nott, Crantock nr. Newquay, England

[73] Assignee: Anglo-American Clays Corporation, Sandersville, Ga.

[ * ] Notice: The portion of the term of this patent subsequent to Jun. 27, 1995, has been disclaimed.

[21] Appl. No.: 707,713

[22] Filed: Jul. 21, 1976

[51] Int. Cl.[2] ..... B03D 1/02
[52] U.S. Cl. ..... 209/166
[58] Field of Search ..... 209/166, 169

[56] References Cited

U.S. PATENT DOCUMENTS

| | | | |
|---|---|---|---|
| 3,450,257 | 6/1969 | Cundy | 209/166 X |
| 3,480,143 | 11/1969 | Mitzmager | 209/166 |
| 3,804,243 | 4/1974 | Yang | 209/166 |
| 3,979,282 | 9/1976 | Cundy | 209/169 X |

FOREIGN PATENT DOCUMENTS

| | | | |
|---|---|---|---|
| 1,175,264 | 8/1964 | Fed. Rep. of Germany | 209/166 |

*Primary Examiner*—Robert Halper
*Attorney, Agent, or Firm*—Stefan J. Klauber

[57] ABSTRACT

Complex phosphate esters or salts thereof, of a non-ionic surface active compound, are utilized as collector agents for removing titanium-based impurities from kaolin clays in a froth flotation process.

6 Claims, No Drawings

BRIGHTENING OF CLAY BY FROTH FLOTATION

BACKGROUND OF INVENTION

This invention relates generally to methods for beneficiation of kaolins and other clays, and more specifically relates to a method for improving the brightness of kaolin clays by removal of titaniferous discolorants therefrom.

Natural clays, including kaolin clays, frequently include discoloring contaminants in the form of iron and/or titanium-based impurities. Quantities of titanium-based impurities are particularly significant in the case of the sedimentary kaolins of Georgia, where such impurities are commonly present as iron stained anatase and rutile. In order, therefore, to refine the clay and bring the brightness characteristics of the resultant product to a level acceptable for such applications as paper coating, various techniques have been used in the past to remove such discoloring impurities. Thus, for example, hydrosulfites have been widely used for converting at least part of the iron-based (or "ferruginous") impurities to soluble forms, which may then be removed from the clay.

Among the most effective methods for removing titaniferous impurities, including e.g. iron stained anatase, are the well-known froth flotation techniques. According to such methods, an aqueous suspension or slurry of the clay is formed, the pH of the slurry is raised to an alkaline value, for example, by addition of ammonium hydroxide, and a collector agent is added. The slurry is then conditioned by agitating same for a relatively sustained period. A frothing agent, for example, pine oil, is added to the conditioned slurry, after which air is passed through the slurry in a froth flotation cell, to effect separation of the impurities along with the collector agent.

Further details regarding the use of froth flotation techniques for removing titanium-based impurities from kaolins, may be found at numerous points in the prior art, including, for example, in U.S. Pat. No. 3,450,257 to E. K. Cundy. The Cundy disclosure will be found illustrative further, of the fact that the prior art has almost universally regarded fatty acids, most notably oleic acid, as the collector agents appropriate and effective for use where titanium-based impurities are to be removed.

Within more recent years it has been reported that certain classes of phosphate esters can serve as collector agents in mineral beneficiation processes. Thus, for example, U.S. Pat. No. 3,480,143 to Mitzmager et al, teaches that certain acid esters of phosphorous acids are useful in flotation separation of a siliceous ore into a floated heavy mineral fraction, and a non-floated siliceous fraction. Of perhaps more pertinence to the present invention are the disclosures of Yang, U.S. Pat. Nos. 3,804,243 and 3,837,488, wherein complex phosphate esters of the type considered in the present invention are reported as useful in flotation processes for separating mica and kaolin clays in a crude ore containing both components.

SUMMARY OF INVENTION

Now in accordance with the present invention, it has unexpectedly been found that certain complex phosphate esters or salts thereof of a non-ionic surface active compound, effect outstanding results when utilized in a froth flotation process as collector agents for removing titanium-based impurities from kaolin clays rich in such contaminants. In a typical procedure in accordance with the invention, an aqueous dispersion of the contaminated clay is formed, which dispersion is blunged and conditioned in the presence of the aforementioned collector agent, after which the blunged and conditioned slurry is subjected to a froth flotation treatment to effect separation of the contaminants with the froth. In a preferable procedure the solids content of the slurry during the blunging and conditioning step is in the range of 25–65%, and the pH of the slurry is brought to the range of 7 to 10. At least 10 hp-hr of energy is dissipated per ton of solids during the blunging and conditioning step; and preferably over 25 hp-hr per ton of solids, is thus dissipated. A preferred range of addition for the complex phosphate ester collector agent is from about 2 to 7 lbs/ton of solids in the slurry.

DESCRIPTION OF PREFERRED EMBODIMENTS

Preferable complex phosphate esters for use in the present invention are those described in detail in U.S. Pat. No. 3,567,636 to William Katzenstein. The disclosure of the Katzenstein patent with regard to the composition of these esters, and the mode of preparation thereof, is incorporated herein by reference. As is indicated in the cited patent, the said materials may be characterized as phosphate esters or salts thereof, of a non-ionic surface active compound, the phosphate ester being selected from the group consisting of mono-esters, di-esters and mixtures thereof. The non-ionic surface active compound is the condensation product of an organic hydroxy compound of from 8 to 50 carbon atoms, selected from the group consisting of aklyl phenols and alkanols with at least one mole of an alkylene oxide having from 2 to 3 carbon atoms, the non-ionic surface active compound containing a maximum of about 50% by weight of alkylene oxide, based on the weight of the non-ionic surface active compound. Many of these phosphate esters are commercially available from the GAF Corp., New York, N.Y., under the trade name "GAFAC". The commercial products are usually mixtures of mono- and di-esters. A typical such product useful in the invention is commercially available under the designation "GAFAC RM510". This composition is believed to be a mixture of mono-ester and di-ester, principally di-ester, wherein the mono-ester constituent has the structural formula:

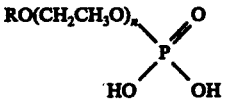

(1)

wherein R = alkylaryl and $n$ is 5 to 7; and wherein the di-ester constituent has the structural formula:

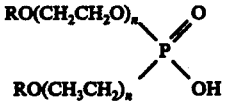

(2)

wherein R = alkylaryl and $n$ is 5 to 7. The said ester can be used in salt form, e.g. as the sodium, ammonium, calcium or magnesium salt. In use the acid is converted to alkali metal salt form in the basic clay slurry.

More generally the mono- and di-phosphated agents used in the invention may be represented by the following formulae:

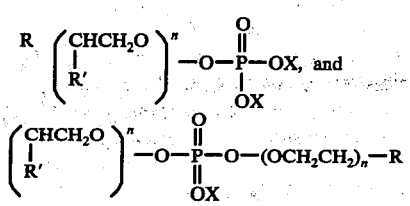

(3)

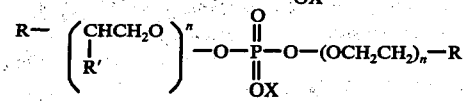

(4)

wherein R′ represents H, or methyl; X may be hydrogen, alkali metal, alkaline earth metal, e.g. calcium, magnessium, barium, etc., ammonium, substituted ammonium (e.g. amine); *n* equals the number of moles of alkylene oxide necessary to yield a final product containing up to 50% by weight of the alkylene oxide previously discussed; and R is the alcohol or phenol hydrophobe nucleus.

In order to demonstrate the efficacy of the present invention, a series of tests were run, wherein relatively discolored kaolin clays were subjected to froth flotation treatments by use of the technique of the invention, with the result of such treatment being compared with conventional froth flotation treatments effected with the most common collector agent of the prior art, i.e. oleic acid. The clays utilized in the tests were sedimentary soft Georgia kaolins, typically including a $TiO_2$ content of the order of 1.5%, or thereabouts.

In a typical procedure the crude clay was blunged and conditioned by forming an aqueous alkaline dispersion of the clay, the pH being adjusted to about 7 to 10 with ammonium hydroxide. In a number of instances, as will be evident in Table I hereinbelow, the dispersion included as a deflocculating agent sodium silicate, the silicate being present in ranges equivalent to up to 16#/ton, more generally in the range of from about one-half to 16#/ton. The blunging and conditioning steps are preferably conducted simultaneously whereby the collector agent, i.e. the complex phosphate ester or the control oleic may partially function as a dispersant thereby enabling minimization of the quantity of sodium silicate used. This is advantageous in that sodium silicate when present in excess, acts as a depressant in froth flotation.

The clay slurry, during the blunging and conditioning operations may include from about 25 to 65% solids. The conditioning process is preferably continued for sufficient time to dissipate at least 25 hp-hr of energy per ton of solids, although more generally the invention is effective where as little as 10 hp-hr per ton of solids is dissipated. The blunged and conditioned slurry after addition of a frothing agent as, for example, pine oil, is then subjected to a conventional treatment in a froth flotation cell, i.e. air is passed through the slurry in said cell to effect separation of impurities from the clay.

EXAMPLE I

In Table I hereinbelow, flotation results are set forth for a series of four different complex phosphate esters of the type discussed above, the results being compared to the use of oleic acid under similar conditions. The product identified as RM-510 has been discussed above, and is an acid ester (aromatic hydrophobic base) 100% active, pouring at 5° C ASTM pour point. This ester is soluble in aromatic solvents and kerosene, and is dispersible in water. The RM-710 is another GAFAC reagent, also an acid ester 100% active, 15° C ASTM pour point; it is similar to the RM-510 product, but also water soluble.

TABLE I

| | FLOTATION RESULTS | | | | |
|---|---|---|---|---|---|
| Collector Reagents: | RM-510 | RM-510 | RM-710 | RM-710 | Oleic Acid |
| Silicate mls | 25.0 | 35.0 | 35.0 | 60.0 | 30.0 |
| $NH_4OH$ mls | 15.0 | 5.0 | 10.0 | 5.0 | 30.0 |
| Collector mls | 2.0 | 1.0 | 2.0 | 1.0 | 4.0 |
| pH | 9.0 | 8.0 | 9.0 | 7.8 | 9.5 |
| Solids % | 60.0 | 60.0 | 60.0 | 60.0 | 60.0 |
| Cond. Time (min) | 20 | 20 | 20 | 20 | 20 |
| Prod. Brightness | 88.1 | 87.9 | 87.3 | 85.6 | 87.9 |
| Prod. $TiO_2$% | 0.28 | 0.46 | 0.46 | 0.35 | Not Det. |
| 3μ Leached Br. | 91.4 | 91.3 | 90.7 | 89.0 | 90.6 |
| 3μ Leached Br . $TiO_2$(%) | 0.50 | 0.69 | 0.77 | 1.20 | 0.37 |

The silicate content set forth in the Table was added as a 10% by weight aqueous solution of commercial N grade silicate, this product being available from Philadelphia Quartz Co. Each 10 ml of this silicate solution corresponds in these tests to an equivalent of 1.0 lbs/ton of solids of sodium silicate as received. The $NH_4OH$ was added as a 15% by weight aqueous solution to yield the pH indicated. Product brightnesses are set forth for the purified product as derived from the flotation cell with the $TiO_2$ content in percent being specified for the said products. In all instances in the specification it will be understood that brightness values are the so-called GE brightness, which have been obtained according to the standard specification established by TAPPI procedure, T-646m-54. Comparable leached brightnesses were obtained by centrifuging the recovered flotation product to yield a substantially −3 micron fraction, and subjecting same to a conventional leaching treatment with sodium hydrosulfite at an additional level of 8#/ton.

The Table will clearly establish that the product brightnesses and the leached brightnesses yielded by the use of the collector agents in the present invention are at least equal, and in many instances superior to those yielded by use of the conventional collector agent, oleic acid, when both reagents are utilized under identical conditions.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly the invention is to be broadly construed, and limited only by the scope and spirit of the claims now appended hereto.

I claim:

1. A method for removing titaniferous discoloring contaminants from a kaolin clay, to thereby increase the brightness of said clay, said method comprising:

forming an aqueous dispersion of said clay, and blunging and conditioning said dispersion in the presence of a collector agent for said titaniferous contaminants, said agent comprising a complex phosphate ester or salt thereof, of a non-ionic surface active compound; said phosphate ester being selected from the group consisting of mono-esters, di-esters, and mixtures thereof; and said non-ionic surface active compound being the condensation product of an organic hydroxy compound of from 8 to 50 carbon atoms selected from the group consisting of alkyl phenols and alkanols with at least one mole of an alkylene oxide having from 2 to 3 carbon atoms, the non-ionic surface active compound containing a maximum of about 50% by weight of alkylene oxide based on the weight of the non-ionic surface active compound; and subjecting said blunged and conditioned slurry to a froth flotation treatment to effect separation with said froth of said collected titaniferous contaminants.

2. A method in accordance with claim 1, wherein said dispersion during said blunging and conditioning step includes 25% to 65% solids.

3. A method in accordance with claim 1, wherein the pH of said dispersion is in the range of from about 7 to 10.

4. A method in accordance with claim 1, wherein at least 10 hp-hr of energy per ton of solids is dissipated during said blunging and conditioning step.

5. A method in accordance with claim 4, wherein at least 25 hp-hr of said energy are dissipated during said blunging and conditioning step.

6. A method in accordance with claim 5, wherein said collector agent is added in concentrations of from 2 to 7 pound/ton solids in said slurry.

* * * * *